United States Patent [19]

Snell

[11] Patent Number: 5,040,705

[45] Date of Patent: Aug. 20, 1991

[54] FLOW CONTROL APPARATUS FOR CONTAINER VALVE

[75] Inventor: Robert Snell, Fonthill, Canada

[73] Assignee: Stoffel Seals of Canada, Ltd., Ontario, Canada

[21] Appl. No.: 389,296

[22] Filed: Aug. 3, 1989

[30] Foreign Application Priority Data

Aug. 10, 1988 [CA] Canada ..... 574386

[51] Int. Cl.[5] ..... B65D 83/14

[52] U.S. Cl. ..... 222/402.15; 222/402.25

[58] Field of Search ..... 222/402.11, 402.13, 222/402.15, 402.14, 402.21, 402.22, 402.23, 402.24, 402.25, 175, 513; 251/95, 98, 111

[56] References Cited

U.S. PATENT DOCUMENTS 4,165,825 8/1979 Hansen ..... 222/513

FOREIGN PATENT DOCUMENTS 8702335 4/1987 World Int. Prop. O. ..... 222/402.15

*Primary Examiner*—Michael S. Huppert
*Assistant Examiner*—P. Derakshani
*Attorney, Agent, or Firm*—Antonelli, Terry, Stout & Kraus

[57] ABSTRACT

A flow control apparatus for controlling the flow of a material from a container valve comprises a flow control member adapted to be mounted on the valve for rotation relative to the valve for adjustably positioning the flow control member relative to the valve and container and thereby adjustably setting a maximum permissible flow rate of material which can be dispensed from the container through the valve. A trigger is mounted on the container and pressed for moving the flow control member and valve stem to dispense material from the container. A ring is rotatably mounted on an annular rim of the container. The rim mounts the trigger so that it can rotate the the flow control member. Rotation of the ring rotates the trigger, and in turn, the flow control member in an easy, safe manner without risk of possible injury to the fingers from contact with a stationary trigger support. The container is preferably necked at its upper end such that the annular diameter of the mounting ring on the annular rim of the container does not protrude outwardly of the cylindrical side wall of the container for safety and compactness in use.

10 Claims, 3 Drawing Sheets

FLOW CONTROL APPARATUS FOR CONTAINER VALVE

TECHNICAL FIELD

The present invention relates to a flow control apparatus for controlling the flow of a material from a valved container.

BACKGROUND ART

It is known, as in U.S. Pat. No. 4,165,825, for example, to provide a valve for a pressurized container with a flow control or locking member which is mounted on the outer periphery of a valve stem with screw threads. The flow control member in this known device is provided with a pair of opposed outwardly extending finger-engaging flanges to assist in rotating the flow control member. When such flow control member is screwed downwardly toward the adjacent container, the lower end of a downwardly and outwardly flaring skirt of the flow control member engages the end wall of the mounted valve cup and prevents actuation of the valve. For dispensing material, the flow control member is screwed upwardly a desired distance to permit the valve stem to be depressed and hence opened a selected amount. The flow rate of material dispensed is a function of the height of the flow control member since this determines the extent of possible opening of the valve. In particular, when the flow control member is moved upwardly only a short distance and the valve is then depressed, either vertically or by tilting, the edge of the skirt of the flow control member engages the end wall of the valve cup after the valve has been unseated and moved only a small distance so that the material is slowly dispensed. If the flow control member is rotated to a location relatively higher on the stem of the valve, the opening between the valve stem and its associated seat is increased and accordingly the flow rate of the material being dispensed is increased. This type of flow control member is desirable because it enables the user to accurately control the rate at which material is being dispensed such as when dispensing a caulking compound or the like, to allow the user to form a perfect bead of material along the joint being caulked.

This known flow control apparatus is illustrated in FIGS. 1 and 2 of the drawings wherein it is seen that the flow control or locking member 1 is mounted by rotation by cooperating screw threads 2 on valve stem 3 of a valve 4. The valve is secured in the end wall 5 of a container 6 with a resilient grommet 7 for dispensing pressurized material such as caulking or the like from the container. The flow control member includes a skirt 8 for engaging the end wall 5 and finger-engaging flanges 9.

In this known flow control arrangement, both the valve and the flow, control member are manipulated by the fingers of the user. This can be tedious and may require tilting the valve in a way in which renders it more difficult to apply the dispensed material from the dispensing tip 10 as shown in FIGS. 1 and 2.

In another known flow control apparatus, a wire control handle is mounted at the end of the container adjacent the flow control member. This apparatus is shown in FIGS. 3, 4 and 5 wherein the wire control handle is designated 11. The free ends 12 and 13 of the wire of the control handle at one end of the handle are pivotably mounted in openings of a stationary bracket 14 rigidly secured to the upper end of the container.

The bracket is fixed in position on the end of the container and is relatively larger in diameter than the diameter of the container such that the bracket can interfere with or make it more difficult to rotate the flow control member with the fingers and to use the container during dispensing in confined areas. The fingers can also be caught and possibly injured on the mounting bracket. The other end of the control handle is adapted to be pressed by the user to depress the flow control member and valve by a second class lever action during dispensing. Rotation of the flow control member upwardly causes the end of handle to pivot outwardly from the container to permit such dispensing at a flow rate which is a function of the adjusted height of the flow control member. The valve stem on this known flow control arrangement has a flat machined on either side of the stem thereby reducing peripheral thread engagement to approximately 60%. This causes the flow control to "slip" or "jump" threads when vertical pressure is applied.

DISCLOSURE OF THE INVENTION

An object of the present invention is to provide an improved flow control apparatus of the aforementioned type which avoids the disadvantages associated with the known flow control apparatus. More particularly, an object of the invention is to provide a flow control apparatus having a trigger which does not interfere with movement of the flow control member or the use of the container during dispensing. A further object of the invention is to provide a flow control apparatus wherein there is a reduced likelihood of possible injury to the fingers of the user during adjustment of the flow control member or use of the container during dispensing.

A further object of the invention is to provide 100% peripheral engagement of the threads on the valve stem and flow control, thereby providing assurance that the threads will not disengage and "jump" or "skip".

These and other objects of the invention are attained by the improved flow control apparatus of the invention for controlling the flow of a material from a valve container, which comprises a flow control member adapted to be mounted on a valve of a container for rotation relative to the valve for adjustably positioning the flow control member relative to the valve and container to adjustably set a maximum flow rate of material which can be dispensed from the container through the valve, a trigger adapted to be mounted on the container and pressed for moving the flow control member and valve to dispense material from the container, and means for mounting the trigger on the container for rotation with the flow control member. By rotating an assembly of the flow control member and trigger together, the trigger does not interfere with adjustment of the flow control member and thus there is a reduced likelihood of injury to the fingers from contact with the trigger and its support.

According to a further feature of the invention, the means for mounting the trigger on the container includes a ring adapted to be rotatably mounted on an annular rim of the container. The container is preferably necked at its upper end such that when the ring is mounted on the annular rim at the necked end of the container, the ring does not protrude outwardly beyond the cylindrical side wall of the container. This allows the container to be used in narrow spaces for dispensing material such as caulking compound or the like.

The trigger of the invention is in the form of a control handle formed by an elongated member, preferably a wire, which is folded on itself. The free ends of the member are received in respective openings formed in the ring mounted on the annular rim of the container. The ends of the wire are loosely received so as to permit pivoting of the control handle at the ends thereof received in the ring openings during raising and lower of the flow control member with respect to the valve and container.

The means for mounting further includes means on the flow control member for cooperating with the trigger to cause rotation of the trigger to result in rotation of the flow control member. According to the disclosed form of the invention, the cooperating means of the flow control member includes a pair of slots in the flow control member through which the trigger extends. The slots are defined by side wall portions of the flow control member which receive portions of the trigger and prevent substantial relative between the trigger and flow control member about the valve axis.

In use, the flow control apparatus of the invention enables the user to easily grip the relatively larger diameter ring rotatably mounted on the annular rim of the container and rotate the same relative to the container. Since the control handle is mounted in the ring, it also rotates with the ring and it, in turn, rotates the flow control member to either raise or lower the flow control member relative to the valve and the container. If the flow control member is raised relative to the container and valve, the free end of the trigger or control handle is pivoted outwardly from the side wall of the container. The user presses this free end of the handle back toward the container to depress, by a second class lever action, the flow control member and valve stem for actuating the valve to dispense material from the container at a flow rate in accordance with the adjusted position of the flow control member relative to the valve.

These and other objects, features and advantages of the present invention will become apparent from the following description when taken in connection with the accompanying drawings, which show, for purposes of illustration only, one preferred embodiment in accordance with the present invention.

BEST MODE FOR CARRYING OUT THE INVENTION

Figure 1:
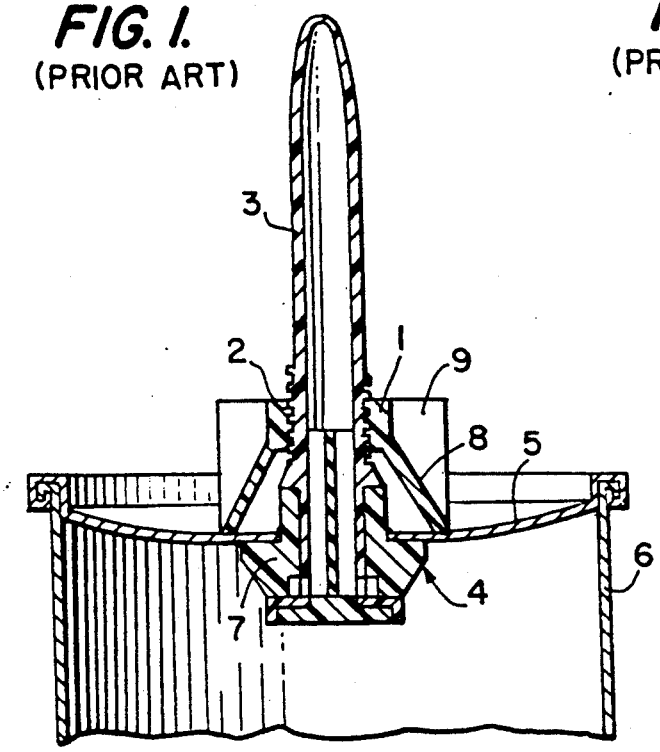
FIG. 1. (PRIOR ART)
FIG. 1 is a cross-sectional view through a known flow control apparatus and its associated valve and container.

Referring now to FIGS. 6–12 of the drawings, a flow control apparatus 15 of the invention is provided on a valve 16 of a container 17 for controlling the flow of a pressurized material from the valved container. The flow control apparatus comprises a flow control member 18 which has a central, longitudinal bore 19 therethrough. The inside of the bore is provided with screw threads 20 which threadedly engage 100% of the cooperating threads 21 on the valve stem of the container. In particular, a stem 22 of the valve 16 is provided with the external screw threads 21 which cooperate with the threads 20 of the flow control member 18. Rotation of the flow control member about the stem of the valve allows one to raise or lower the flow control member relative to the valve and container.

The body of the flow control member 18 has a downwardly and outwardly flaring skirt 23 and a pair of upstanding projections 24, 25 on opposite sides of the body defining respective slots 26, 27 which are undercut at 28 into the main body at the lower portion thereof. The slots receive respective portions of a control lever or trigger 29 for retaining the control lever therein during raising and lowering of the flow control member.

Figure 11:
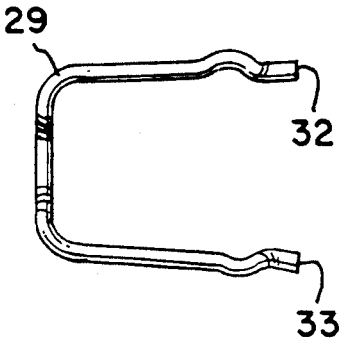
FIG. 11 is a top view of the control lever or trigger of the apparatus of FIGS. 6–8.
Figure 12:
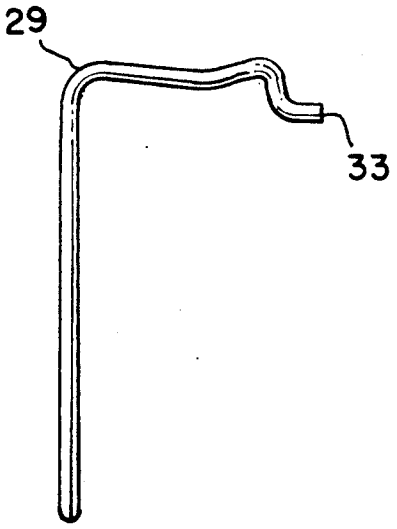
FIG. 12 is a side elevational view of the control lever or trigger of the apparatus of FIGS. 6–8.
Figure 10:
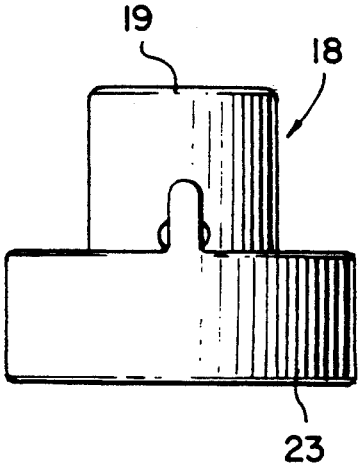
FIG. 10 is a side elevational view of the flow control member of the apparatus of FIGS. 6–8 as seen from an angle rotated 90 degrees with respect to the flow control member as shown in FIG. 9.

The control lever or trigger 29 is mounted on the container 17 by means of a ring 30 which is rotatably mounted on an annular rim 31 of the container as by snap fitting, for example. The annular rim 31 in the disclosed embodiment is a double seam between the upper edge of the container side wall and the outer rim of the valve cup which forms the upper end 37 of the container. In the disclosed embodiment the control lever in the form of an elongated member which is folded on itself. The free ends 32, 33 of the elongated member are received in respective openings 34, 35 formed in the ring so as to retain the ends while permitting pivoting of the opposite end of the control lever inwardly and outwardly from the sidewall of the container as the flow control member is lowered and raised, respectively. The control lever is preferably formed of a metal wire which is folded on itself and configured as shown in FIGS. 11 and 12 but it could be formed of other materials such as plastic. Intermediate portions of each side of the wire control lever are retained in the respective undercut slots 26 and 27 of the flow control member during raising and lowering of the flow control member.

Figure 2:
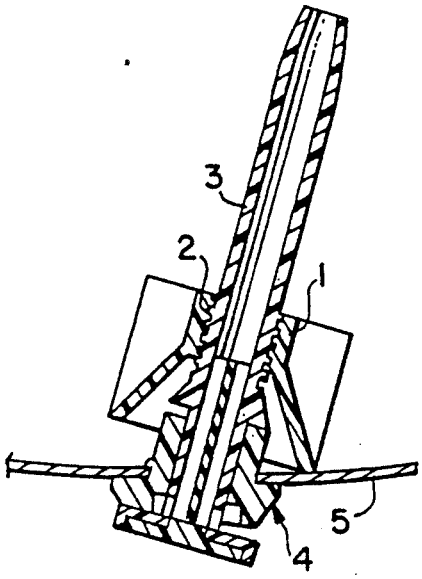
FIG. 2. (PRIOR ART)
FIG. 2 is a cross-sectional view of a portion of the flow control apparatus of FIG. 1 wherein the flow control member has been raised and tilted with the valve for dispensing material from the container.
Figure 3:
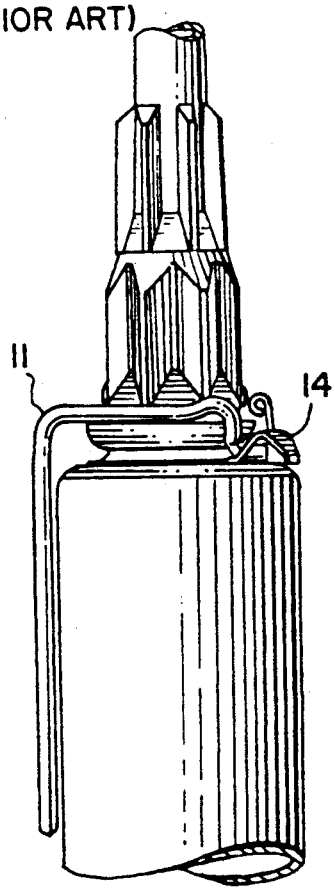
FIG. 3. (PRIOR ART)
FIG. 3 is a side elevational view of a portion of another known flow control apparatus wherein a control handle and flow control member of the apparatus are in a locked or non-dispensing position.
Figure 4:
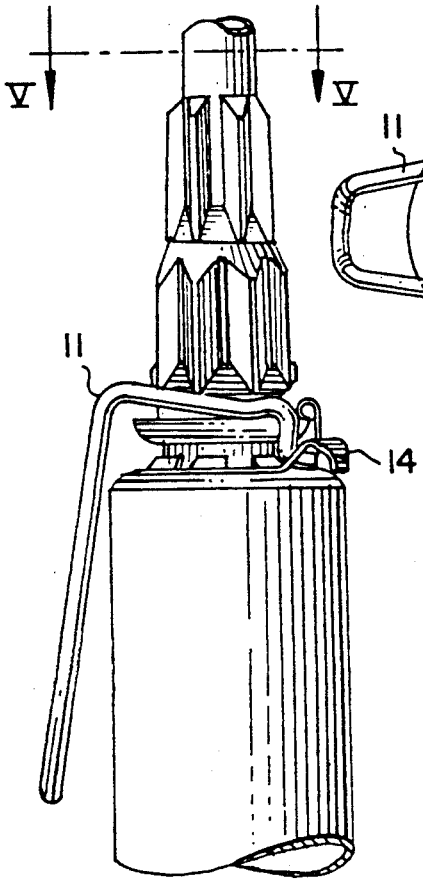
FIG. 4. (PRIOR ART)
FIG. 4 is a side elevational view of the known flow control apparatus of FIG. 3 wherein the flow control member and control lever are located in a position where material can be dispensed from the container by depressing the lower end of the control lever inwardly toward the container to depress the valve on the container to open the valve and dispense the material.
Figure 5:
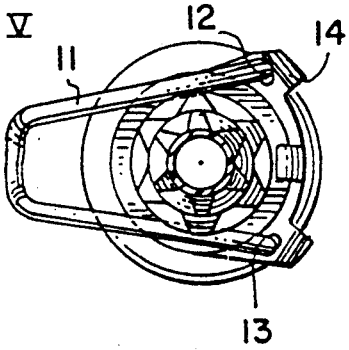
FIG. 5. (PRIOR ART)
FIG. 5 is a cross-sectional view of the apparatus of FIG. 4 taken along the line V—V.
Figure 6:
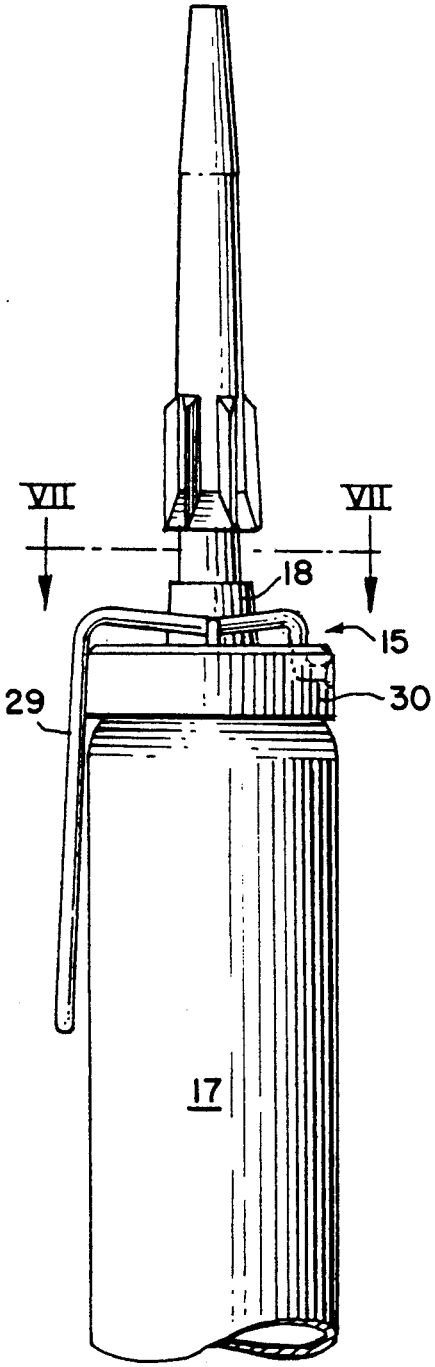
FIG. 6 is the side elevational view of a flow control apparatus with valve and container according to a preferred embodiment of the invention.
Figure 7:
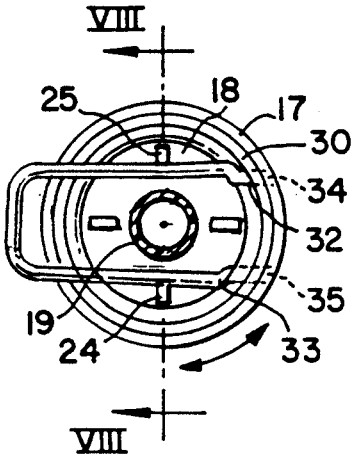
FIG. 7 is a cross-sectional view of the apparatus of FIG. 6 taken along the line VII—VII.
Figure 8:
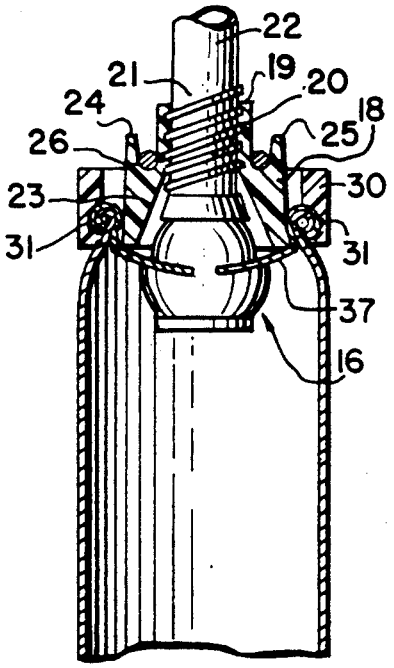
FIG. 8 is a partial cross-sectional view through the flow control apparatus of FIGS. 6 and 7 taken along the line VIII—VIII in FIG. 7.
Figure 9:
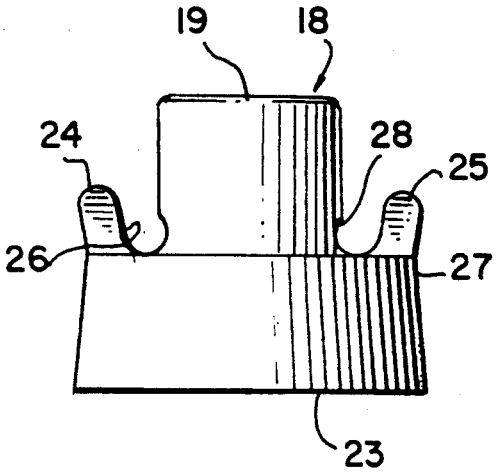
FIG. 9 is a side elevational view of the flow control member of the flow control apparatus of Figs. 6–8.

When it is desired to adjust the position of the flow control member, the user simply grasps the container 17 and the ring 30 and rotates the ring counterclockwise relative to the container. This causes rotation of the control lever 29 because the free ends thereof are retained in the openings 34 and 35 in the ring. Rotation of the control lever, in turn, causes rotation of the flow control member 18 because the upstanding projections 24 and 25 on the flow control member engage the intermediate portions of the lever retained within the slots 26 and 27 of the flow control member and preclude substantial relative rotation between the flow control member and control lever. The ring can be turned clockwise relative to the container body until the lower skirt 23 of flow control member engages the upper end 37 of the container 17. In this position, the depending portion of the control lever extends essentially parallel with the side wall of the container and the valve is locked so material cannot be dispensed from the container. Rotation of the ring counter clockwise with respect to the container causes concurrent rotation of the flow member which is raised relative to the valve stem and container during such rotation. The upward movement of the flow control member pivots the control lever about a fulcrum at the free ends 32, 33 retained in the openings 34, 35 in the ring upwardly so that the opposite end of the control lever moves away from the side wall of the container in the direction of the arrow shown in FIG. 6. In this raised position, pressing the depending end of the control lever in the direction of the side wall of the container forces the valve of the container downwardly to open the valve to dispense material from the container through the passage (not shown) in the valve 16 and valve stem 22. The operation of the valve 16 in this regard is like that of the conventional valve 4 in FIGS. 1 and 2. The degree to which the valve can be depressed depends upon the extent or height of the flow control member skirt above the upper end of the container. The greater the height or spacing, the further the valve can be depressed and hence the larger the flow rate of material which can be dispensed from the container. Because of the relatively large diameter of the ring, and the fact that the control lever moves with the ring and the flow control member during adjustment of the height of the flow control member, the flow control apparatus can be easily gripped and adjusted without risk of possible injury to the fingers by a stationary mounting bracket as in the prior art flow control apparatus illustrated in FIGS. 3-5. The ring is also dimensioned so as not to protrude outwardly beyond the side wall of the necked cylindrical container so as not to interfere with the use of the container during dispensing. The lever can be used to clip on to a person's belt when not in use, leaving both of the person's hands free.

The container of the invention is formed of metal and contains a pressurized material therein which is dispensed through the valve upon opening of the valve with the flow control apparatus of the invention. The valve 16 is of the type which when depressed downwardly by the flow control apparatus of the invention is opened to release pressurized material from the container through the valve stem and the dispensing nozzle. For example, the valve can be the type having a resilient grommet or the like which allows the valve to be opened when the valve stem is pressed to compress the grommet as in the prior art flow control apparatus of FIGS. 1 and 2. Of course other types of valves and containers known to the skilled artisan could be used with the invention.

The flow control member and ring are preferably formed of plastic material as by molding. The inner surface of the ring has an annular groove 38 formed therein toward the lower edge of the ring for receiving the outer surface of the annular rim of the necked container. The diameter of the inner surface of the ring at the lower end thereof is slightly smaller than the outer diameter of the annular rim of the container for the purpose of obtaining a snap fit. Once snapped in position on the container, the ring can be rotated easily relative to the container because of the reception of the annular rim in the groove 38 on the inner surface of the ring.

While I have shown and described only one embodiment in accordance with the present invention, it is understood that the same is not limited thereto, but is susceptible to numerous changes and modifications as known to those skilled in the art. Therefore, I do not wish to be limited to the details shown and described herein, but intend to cover all such changes and modifications as are encompassed by the scope of the appended claims.

I claim:

1. A flow control apparatus for controlling the flow of a material from a valved container, comprising a flow control member adapted to be mounted on a valve of a container for rotation relative to said valve for adjustably positioning the flow control member relative to the valve and container and adjustably setting a maximum flow rate of material which can be dispensed from the container through the valve, a trigger adapted to be mounted on said container and pressed for moving said flow control member and valve to dispense material from said container, and means for mounting said trigger on said container for rotation with said flow control member upon rotation of said mounting means.

2. A flow control apparatus according to claim 1, wherein said means for mounting said trigger on said container includes a ring adapted to be rotatably mounted on said container.

3. A flow: control apparatus according to claim 2, wherein said ring is adopted to be mounted on an annular rim of said container.

4. A flow control apparatus according to claim 2, wherein said trigger is in the form of a control handle formed by an elongated member which is folded on itself, the free ends of the elongated member being received in respective openings formed in said ring.

5. A flow control apparatus according to claim 4, wherein said elongated member is a wire.

6. A flow control apparatus according to claim 1, wherein said means for mounting includes means on said flow control member for cooperating with said trigger to cause rotation of said trigger to prevent substantial relative rotation between said flow control member and trigger.

7. A flow control apparatus according to claim 6, wherein said cooperating means of said flow control member includes at least one slot in said flow control member through which said trigger extends, said slot being defined by side wall portions of said flow control member which cooperate with said trigger for preventing substantial relative rotation between said trigger and flow control member.

8. A flow control apparatus according to claim 7, wherein said trigger is in the form of a control handle formed by an elongated member which is folded on itself, the free ends of the member being received in respective openings formed in said means for mounting, respective portions of said elongated member passing through respective slots in said flow control member.

9. In a valve for selectively dispensing material from a pressurized container, a flow control member mounted on the valve for rotation relative to the valve for adjustably positioning the flow control member relative to the valve and its associated container and thereby adjustably setting a maximum flow rate of material which can be dispensed from the container through the valve, and a trigger adapted to be mounted on the container and pressed for moving the flow control member and valve to dispense material from the container, the improvement comprising a mount for mounting said trigger on the container so that said trigger can be rotated with said flow control member upon rotation of said mount.

10. In a pressurized container having a valve for selectively dispensing material from the pressurized container, a flow control member mounted on the valve for rotation relative to the valve for adjustably positioning the flow control member relative to the valve and container to adjustably set a maximum flow rate of material which can be dispensed from the container through the valve, and a trigger mounted on the container and adapted to be pressed for moving the flow control member and valve to dispense material from the container, the improvement comprising means for mounting the trigger on the container for rotation with the flow control member, said container having an annular rim at an upper end of said container, and said mounting means being mounted on said annular rim of the container.

* * * * *